United States Patent [19]

Wisnosky et al.

[11] Patent Number: 4,471,226

[45] Date of Patent: Sep. 11, 1984

[54] SAFETY APPLICATOR FOR RADIATION

[75] Inventors: Jerome D. Wisnosky; Albert J. McLaughlin; Daniel P. McGinn, III, all of Lancaster, Pa.

[73] Assignee: Armstrong World Industries, Inc., Lancaster, Pa.

[21] Appl. No.: 348,790

[22] Filed: Feb. 16, 1982

[51] Int. Cl.[3] ..... G21K 1/02; H01J 5/02

[52] U.S. Cl. ..... 250/504 H; 250/493.1; 250/505.1; 250/504 R

[58] Field of Search ..... 250/505.1, 504 H, 504 R, 250/503.1, 495.1, 493.1; 313/112; 378/205

[56] References Cited

U.S. PATENT DOCUMENTS

| | | | |
|---|---|---|---|
| 1,600,867 | 9/1926 | Coolidge | 378/205 X |
| 2,261,215 | 11/1941 | Bird | 250/504 |
| 2,705,290 | 3/1955 | Newman | 250/504 |
| 3,136,890 | 6/1964 | Wain | 250/504 |
| 3,782,889 | 1/1974 | Panico | 432/59 |
| 3,792,230 | 2/1974 | Ray | 250/504 |
| 3,811,044 | 5/1974 | Meador, Jr. | 240/47 |
| 3,970,856 | 7/1976 | Mahaffey et al. | 250/504 |
| 4,167,669 | 9/1979 | Panico | 250/341 |
| 4,314,158 | 2/1982 | Lucido | 250/505.1 |

OTHER PUBLICATIONS

Xenon Corporation, Instruction Book RC-250 Rapid Cure U.V. Flashpolymerization System.

*Primary Examiner*—Alfred E. Smith
*Assistant Examiner*—Jack I. Berman

[57] ABSTRACT

An improved safety housing for a radiation source used in polymerization of materials. The housing includes an interlock feature which prevents activation of the source unless the shield is placed upon the work piece. A spring loaded switch on the surface which abuts the work piece and a second magnetic switch are used to prevent accidental activation. The unit uses a mechanically interlocking locator plate which is aligned in advance of the insertion of the housing into it, and shields the operator from any stray radiation when in use.

7 Claims, 4 Drawing Figures

SAFETY APPLICATOR FOR RADIATION

SUMMARY OF THE INVENTION

This invention relates generally to radiant energy and more specifically to a radiation source consisting of a portable unit with a radiation shield member.

The rapid curing of resin systems by the use of radiant energy within a broad spectral range is well established. The process of polymerization can actually be accomplished by irradiation of several forms of energy of which the most common is probably heat, but the use of ultraviolet energy has particular advantages in that the wavelength of ultraviolet energy permits sharp focus, and the devices for generation of ultraviolet power sufficient for polymerization can be small, have relatively low power consumption and be easily portable. U.S. Pat. No. 4,167,669 by C. R. Panico, for instance, describes an apparatus which pulse activates ultraviolet lamps for the purpose of accelerating the polymerization process.

While such devices have been generally available in portable systems with hand held ultraviolet applicators, such as the one shown in U. S. Pat. No. 3,970,856, the relatively low ultraviolet power output of many of the units has resulted in the neglect of safety considerations. However, as the power output range has increased for industrial use, and as the devices have become more generally used in high production situations, accidental exposure risks have increased.

Although hand held units remain quite satisfactory for many industrial applications, the hazard of the activation of an radiation applicator while it is directed at the operator or some other person in the vicinity is very real and very dangerous. The exposure of the human eye to high intensity ultraviolet radiation can cause severe eye damage and even blindness, and even exposure of skin to the radiation can cause severe burns, actually a "sunburn".

It is, therefore, desireable to in some way eliminate the possibility of misdirecting the radiation while still permitting the versatility of hand held application, so that the work area treated by radiation can be easily and quickly changed in a production setting.

The present invention accomplishes the restriction of the radiation exposure to a specific work area and prevents accidental exposure of the operator or nearby personnel, but essentially retains the advantages of a highly portable applicator of radiant energy. This is done by the use of a two part system which includes a locator plate to predetermine the area to be treated with radiation and an interlocking radiation head which is activated by a force actuated switch located on the same surface as an aperture for radiation emission.

The applicator is accomodated into the locator plate by a tight fitting moulding which seals the radiation leaks and restricts exposure to the area determined by the locator plate, while the force activated switch location assures that the unit will be activated only when the radiation port is mated on a surface. Since the weight of the applicator head is not sufficient to activate the switch, merely placing the unit in the locator plate or on a flat surface will not cause accidental turn-on. To initiate the radiation it is necessary to positively push downward on the applicator while the force activated switch and the radiation port are on a surface.

An additional switch can also be installed on the applicator to assure that the applicator is always used in conjunction with the locator plate. This accomplished by the use of a magnetically activated switch located in the applicator head along a surface which is adjacent to the locator plate when the applicator is inserted into the locator plate. The locator plate is then constructed with a magnet at the location which matches the magnetically activated switch when the applicator is properly positioned into the locator plate. The magnetically operated switch, wired in series with the force activated switch, then assures proper insertion into the locator plate before the radiation source can be activated by the force actuated switch.

An additional safety feature of the shielded housing is the mechanical lock-out to prevent unintentional activation of the radiation source. For example, the lock-out can consist of a springloaded mechanical bar located to interfere with the movement of the force actuated switch. The initiation of the radiation therefore requires a two step operation which involves both releasing the mechanical lock-out and applying force to the applicator head when it is resting on a surface. This dual action prevents the accidental activation of radiation when, for instance, the applicator is being moved from one work area to another, by the operator accidentally wrapping his hand around the unit and pushing the switch with a finger tip.

The specific procedure for operating the unit involves aligning the locator plate with its aperture over the area to be exposed to radiation. With the radiation source power supply plugged into an electric power source and turned on, the applicator head is inserted into the locator plate with its aperture downward, the lock-out bar is released, and hand pressure is applied atop the applicator. This pushes the applicator down against the force activated switch to turn the radiation source on. If the locator plate magnet interlock is being used, the simple operation of properly inserting the applicator into the locator plate operates that switch.

The locator plate and the force actuated and magnetic switches whether used independently or together, thus each fulfill a requirement for safe operation of the hand held applicator. The locator plate, which may either be flexible or inflexible, locates the applicator and properly aims the radiation while preventing leakage around the periphery of the applicator. The force actuated switch and its mechanical lock-out bar encourage use only on a flat surface and prevent accidental activation while permitting ease of normal operation, and the magnetically operated switch assures operation only in association with the protective locator plate.

DETAILED DESCRIPTION OF THE INVENTION

Figure 1:
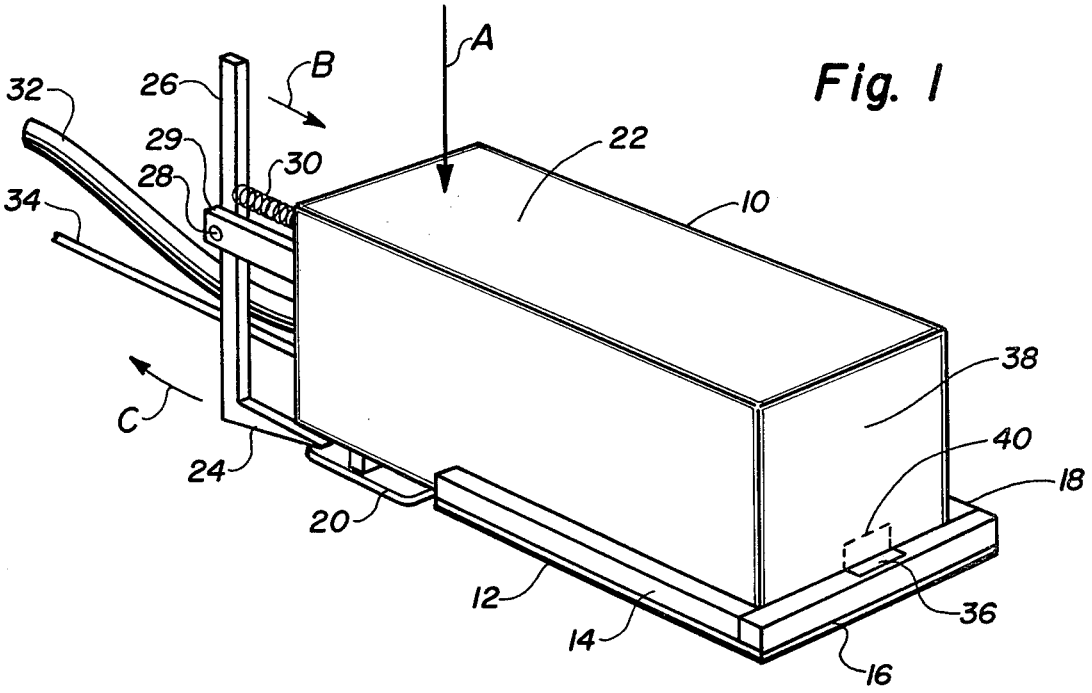
FIG. 1 is a perspective view of the preferred embodiment of the invention with the applicator head shown inserted into the locator plate.

FIG. 1 is a perspective view of the preferred embodiment of the invention in which hand held applicator head 10, which uses a xenon lamp (FIG. 4), is shown inserted into locator plate 12. Locator plate 12 is constructed with raised, tight fitting mouldings or lips 14, 16 and 18, which seal the lower periphery of applicator 10 and, particularly when lips 14, 16 and 18 are constructed of or coated with non-reflective material, prevent any significant leakage of ultraviolet radiation from the assembly. The measured ultraviolet leakage is, in fact, only about 3% of the level of ultraviolet coming in through a closed glass window during daylight hours.

FIG. 1 also shows force actuated switch 20 projecting from the bottom surface of applicator 10. Once the unit is positioned as shown, the action required to activate switch 20 is a force applied upon the top surface 22 of applicator 10 in direction A. No movement of force activated switch 20 will, however, occur unless lock-out mechanisn 24 has been moved from its locking position, as shown, to prevent its interference with force activated switch 20.

Lock-out mechanism 24 is moved by moving arm 26 in direction B, thus pivoting arm 26 on pin 28 held by support 29, and causing lock-out mechanism 24 to move in direction C. When arm 26 is released it is automatically returned to its lock-out position by the action of return spring 30.

All electrical power and control connections to the switches and the lamp contained within applicator 10 are made through cable 32 to a conventional lamp power supply and control unit (not shown). Pipe 34 serves to supply air cooling to the lamp or a gas such as nitrogen to produce an inert atmosphere around the work area. The process of polymerization occurs more satisfactorily in an inert atmosphere, so the convenient furnishing of such gas to the enclosed work area can be vital.

Magnet 36 is shown located within sealing lips 16. At that location it is directly accessible to surface 38 of applicator 10 within which is located magnetic activated switch 40.

Alternatively, ports may be built into any of the applicator's surfaces, said ports designed so to permit the venting of gas while not permitting the UV radiation to escape.

Figure 2:
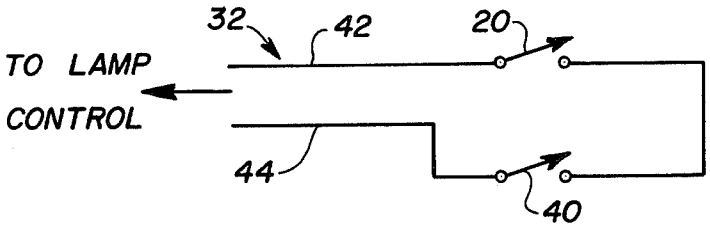
FIG. 2 is a simplified circuit diagram of the switching arrangement within the applicator head.

As shown in FIG. 2 magnetic activated switch 40, if used, is simply wired in series with force actuated switch 20, and together their lines 42 and 44 are carried back through cable 32 to the lamp control (not shown). Within the lamp control system lines 42 and 44 are inserted in series in the circuit which turns the lamp on. The circuit thus requires that both conditions of applicator 10 being on a surface and being within locator plate 12 are fulfilled before the ultraviolet radiation can be initiated.

Figure 3:
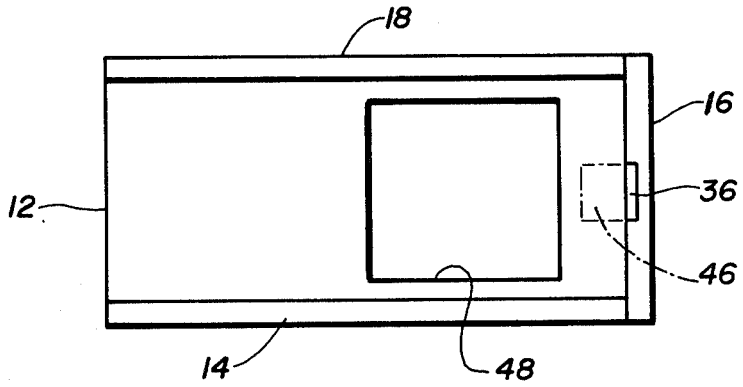
FIG. 3 is a top view of the locator plate.

FIG. 3 is a top view of locator plate 12 showing the location of radiation sealing lips 14, 16 and 18 around the periphery of plate 12 to seal off any radiation leakage. Magnet 36 is located on an edge of one of the lips, in this preferred embodiment lip 16, where it will be in close proximity to a surface of the applicator which can hold the magnetically activated switch. It is also possible to mount magnet 36 in location 46 (shown in phantom lines) within or on top of locator plate 12, since the only essential requirement is that it be adjacent to a surface of the applicator.

Opening 48 in locator plate 12 serves a dual purpose. The first is the more subtle. Since applicator 10 is used with the radiation port downward and on a surface, exact location upon the work area would be a problem because the operator would be working with the applicator masking the work area. A basic function of locator plate 12 is, therefore, to enable the operator to exactly direct the radiation upon the work area. This function is accomplished quite simply by the use of opening 48, within which the work area is framed, before applicator 10 is inserted into locator plate 12 in its predetermined position.

Figure 4:
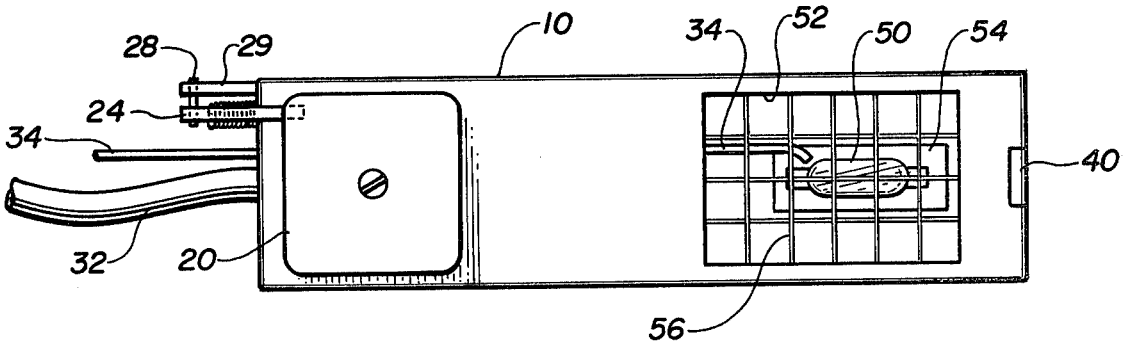
FIG. 4 is a bottom view of the applicator head.

FIG. 4 is a bottom view of applicator 10 showing xenon lamp 50 which emits ultraviolet radiation through radiation port 52, located to align with locator plate opening 48. Reflector 54 is located behind lamp 50 to concentrate the radiation and aim it more precisely at the work area. Pipe 34 can also be seen ending near lamp 50. By rotating pipe 34 the gas exiting it can be directed at either lamp 50 for direct cooling or at the work area below the lamp in order to blanket the work area with inert gas. Wire grid 56 covers radiation port 52 to prevent accidental contact with the electrical connections to lamp 50.

Various other features of applicator 10, previously described, can also be seen in FIG. 4. In particular the location of magnetically operated switch 40 on the end surface of applicator 10, the location of force activated switch 20 on the bottom surface and the position of lock-out mechanism 24 are clearly shown.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, the magnetically actuated switch and the force actuated switch can be used independently or together, or the mechanical lock-out can be constructed with a different mechanical action. Moreover, the actual radiation source can be any one of a numbwer of sources covering the ultraviolet, visible and infra-red wavelengths.

What is claimed as new and desired to be secured by Letters Patent of the United States is:

1. A safety housing for portable radiation applicators comprising:

an applicator assembly including a radiation source, cable means furnishing power and control connections to the radiation source and a radiation port located on a first surface of the applicator assembly, through which radiation is directed to a surface to be irradiated; and a locator plate which is positioned between the surface to be irradiated and the radiation port and which supports the applicator on the surface to be irradiated, said plate being a means into which the applicator assembly fits with close clearances, said plate containing radiation sealing means to prevent peripheral leakage of radiation and including an opening which aligns with the radiation port on the applicator assembly when the applicator assembly is positioned within the locator plate with the radiation port directed at the surface to be irradiated.

2. The safety housing of claim 1 further comprising a force actuated switch means, located on the first surface of the applicator assembly and electrically interconnected with the radiation source, to prevent operation of the radiation source unless the applicator is properly fit in the locator plate and the force actuated switch means is forced against a surface of the locator plate to be activated.

3. The safety housing of claim 2 further comprising a mechanical lock-out mechanism spring loaded to interfere with the action of the force actuated switch, unless a positive action is performed to release the force actuated switch.

4. The safety housing of claim 1 further including a magnetic switch located adjacent to a surface of the applicator assembly and electrically interconnected with the radiation source; and a magnet attached to the locator plate at a location which aligns with the magnetically activated switch when the applicator assembly is properly positioned within the locator plate.

5. The safety housing of claim 1 further including a gas supply means within the applicator assembly directing gas to the region of the radiation port to blanket a work area exposed to radiation with a gas.

6. The safety housing of claim 1 wherein the radiation source comprises a means to generate ultraviolet radiation.

7. The safety housing of claim 1 further including a gas supply means within the applicator assembly directing gas to the region of the radiation source to cool the radiation source.

* * * * *